US005807191A

United States Patent [19]

Nakahara

[11] Patent Number: 5,807,191

[45] Date of Patent: Sep. 15, 1998

[54] IRON GOLF CLUB HEAD

[75] Inventor: Norihiko Nakahara, Hiratsuka, Japan

[73] Assignee: The Yokohama Rubber Co., Ltd., Tokyo, Japan

[21] Appl. No.: 795,204

[22] Filed: Feb. 5, 1997

[30] Foreign Application Priority Data

Feb. 7, 1996 [JP] Japan ..... 8-021494

[51] Int. Cl.[6] ..... A63B 53/04

[52] U.S. Cl. ..... 473/350; 473/349

[58] Field of Search ..... 473/350, 349, 473/324; 273/169

[56] References Cited

U.S. PATENT DOCUMENTS

| | | | |
|---|---|---|---|
| 4,787,636 | 11/1988 | Honma | 473/349 |
| 5,330,187 | 7/1994 | Schmidt et al. | 473/350 X |
| 5,586,947 | 12/1996 | Hutin | 473/350 X |
| 5,595,552 | 1/1997 | Wright et al. | 473/350 X |
| 5,601,501 | 2/1997 | Kobayashi | 473/350 |
| 5,616,088 | 4/1997 | Aizawa et al. | 473/350 X |

FOREIGN PATENT DOCUMENTS

| | | |
|---|---|---|
| 2-84972 | 3/1990 | Japan . |
| 2-264676 | 10/1990 | Japan . |
| 5-123427 | 5/1993 | Japan . |
| 5-285238 | 11/1993 | Japan . |

*Primary Examiner*—Raleigh W. Chiu

*Attorney, Agent, or Firm*—Finnegan, Henderson, Farabow, Garrett & Dunner

[57] ABSTRACT

An iron golf club head comprises a club head body including a hosel portion into which to fit a shaft, a face portion connected to the hosel portion, and a sole portion which is integrally formed to extend from a bottom edge portion of the face portion to a back side, and the club head body is formed integrally with a blade portion for weight adjustment which extends from a top portion of the face portion toward the back side in an obliquely upward direction and a projecting portion for weight adjustment which projects from a back-side end of the sole portion in an upward direction.

6 Claims, 3 Drawing Sheets

IRON GOLF CLUB HEAD

BACKGROUND OF THE INVENTION

The present invention relates to an iron golf club head and, more particularly, to an iron golf club head in which weights are respectively distributed to the top and bottom ends of a club head body so that a longitudinal moment of inertia is made large to reduce a vertical deviation in the direction of flight of a hit ball.

Referring to FIGS. 3 and 4, a club head body 1 of an iron golf club head includes a hosel portion 2 into which to fit a shaft, a face portion 3 connected to the hosel portion 2, and a sole portion 4 which extends from an edge portion 3*a* of the face portion 3 toward a back side. Adjustment of the position of the center of gravity of the club head body 1 is made by attaching a weight G to the back side of the face portion 3 for the purpose of weight distribution.

Various methods for attaching such a weight to a club head body have been proposed. For example, in the club head disclosed in Japanese patent application Kokai publication No. 2-84972, a weight is formed separately from a club head body, and this weight is attached to the back side of a face portion via a weight holding member. In the club head disclosed in Japanese patent application Kokai publication No. 5-123427, a weight is similarly formed separately from a club head body, while the back side of a sole portion is extended, and the separately formed weight is held in such a manner as to be wound around the extended portion. In the club head disclosed in Japanese patent application Kokai publication No. 5-285238, a weight which constitutes a sole portion is formed separately from a club head body, and this weight is fitted onto the back side of a face portion.

However, in any of the aforesaid arrangements in which the separately formed weight is attached to the club head body to adjust the position of the center of weight of the club head body, since a greatly time-consuming operation is needed to attach and adjust the weight, there is the problem of a remarkable increase in the manufacturing cost of a club head.

To cope with the problem, in the club head disclosed in Japanese patent application Kokai publication No. 2-264676, a sole portion is made thicker on a back side than on a face side so that the center of gravity is adjusted.

However, if the thickness of the sole portion is changed forwardly or rearwardly of a club head body as described above, the position of the center of gravity of the club head can be lowered or the center of gravity of the club head body can be adjusted forwardly and rearwardly, but the longitudinal (vertical) moment of inertia of the club head body cannot be made large. This leads to the problem that a vertical deviation in the direction of flight of a hit ball easily occurs. In particular, in the case of an iron golf club head which is designed to take more account of the reliability of distance than the magnitude of carry, a ball needs to be able to be readily lofted high and accurately when it is hit, but if the aforesaid club head is used as such iron golf club head, the lofting angle of a hit ball becomes unstable.

SUMMARY OF THE INVENTION

An object of the present invention is to provide an iron golf club head whose club head body has an increased longitudinal moment of inertia so that a vertical deviation in the direction of flight of a hit ball is reduced and a stable stroke having an accurate carry can be attained, as well as which can readily be worked at low manufacturing costs.

To achieve the above object, an iron golf club head according to the present invention comprises a club head body including a hosel portion into which to fit a shaft, a face portion connected to the hosel portion, and a sole portion which is integrally formed to extend from a bottom edge portion of the face portion to a back side, and the club head body is formed integrally with a blade portion for weight adjustment which extends from a top portion of the face portion toward the back side in an obliquely upward direction and a projecting portion for weight adjustment which projects from a back-side end of the sole portion in an upward direction.

In this manner, the club head body is formed integrally with the blade portion which extends from the top portion of the face portion toward the back side in the obliquely upward direction and the projecting portion for weight adjustment which projects from the back-side end of the sole portion in the upward direction. Since the weight of the club head body is adjusted by varying the respective weights of the blade portion and the projecting portion, working for adding such weights is easy. In addition, since it is not necessary to adjust the weight of the club head body in the conventional manner of attaching a separately formed weight to the club head body, the manufacturing costs of the iron golf club head are extremely low.

Since the projecting portion is provided on the back-side end of the sole portion and, at the same time, the blade portion is provided on the top portion of the face portion, such top and bottom weights increase the longitudinal moment of inertia of the golf club head body so that a vertical deviation in the direction of flight of a hit ball is reduced and a stable stroke having an accurate carry can be attained.

In addition, although in the conventional iron golf club head the club head body is inclined from the top portion of the face portion toward the back side in an obliquely downward direction, in the present invention, the blade portion extends from the top portion of the face portion toward the back side in the obliquely upward direction, so that the face portion appears large to the eyes of a player and the player feels secure when hitting a ball.

DETAILED DESCRIPTION OF THE PREFERRED EMBODIMENT

Figure 1:
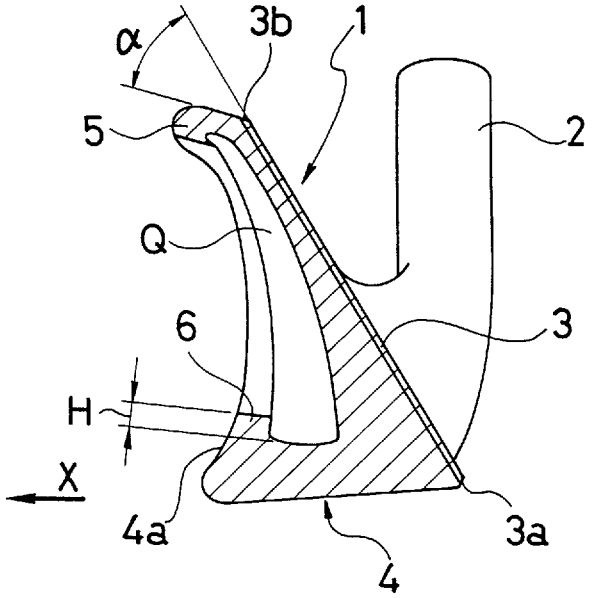
FIG. 1 is a cross-sectional view showing an iron golf club head according to a preferred embodiment of the present invention.
Figure 2:
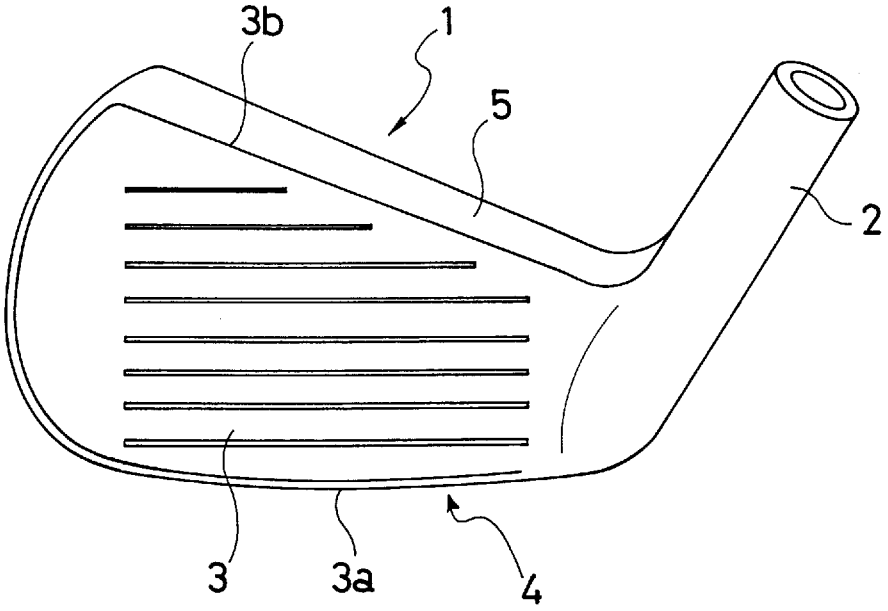
FIG. 2 is a front elevational view of the iron golf club head shown in FIG. 1.
Figure 3:
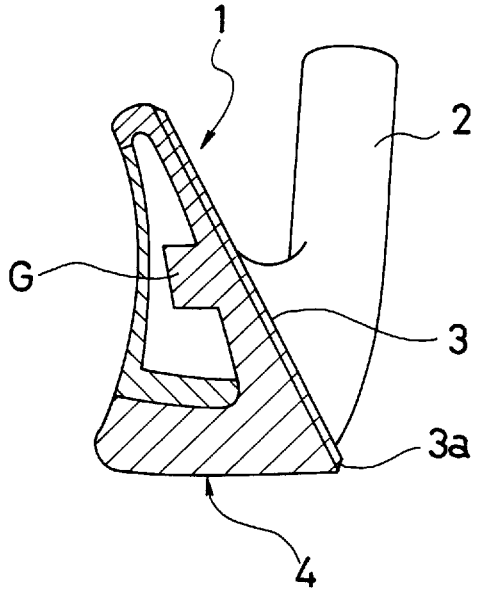
FIG. 3 is a cross-sectional view showing a conventional iron golf club head.
Figure 4:
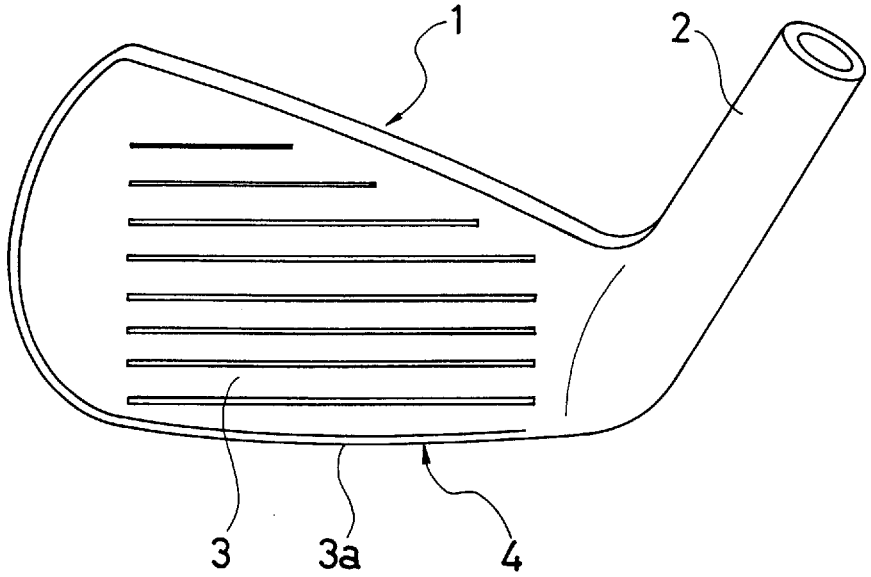
FIG. 4 is a front elevational view of the iron golf club head shown in FIG. 3.

As shown in FIGS. 1 and 2, a club head body 1 includes a hosel portion 2 into which is fit a shaft, a face portion 3 connected to the hosel portion 2, and a sole portion 4 integrally formed to extend from a bottom edge portion 3*a* of the face portion 3 toward a back side X.

A blade portion 5 for weight adjustment is formed integrally with the club head body 1 in such a manner as to extend from a top portion 3*b* of the face portion 3 toward the back side X in an obliquely upward direction. A projecting portion 6 for weight adjustment is formed integrally with a back-side end 4*a* of the sole portion 4 in such a manner as to project from the back-side end 4*a* in an upward direction. By individually varying the weight of the blade portion 5 and the weight of the projecting portion 6, it is possible to adjust the weight of the club head body 1 and the longitudinal moment of inertia thereof.

It is preferable to provide the blade portion 5 so that an inclination angle a relative to the face portion 3 is 40°–60°. If the inclination angle $\alpha$ is less than 40°, air resistance will be excessively large, whereas if the inclination angle $\alpha$ exceeds 60°, the effect of the upward inclination of the blade portion 5 will not be obtained. A height H of the projecting portion 6 from the back-side end 4*a* is set to approximately 1 mm.

Figure 5:
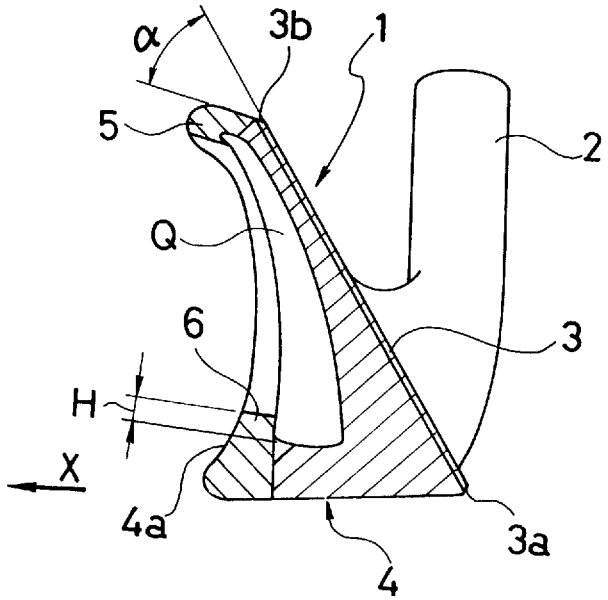
FIG. 5 is a cross-sectional view similar to FIG. 1 of an iron golf club head according to an alternative embodiment of the present invention.

In the present invention, it is possible to adjust the weight of the club head body 1 by arbitrarily setting the length of the blade portion 5 and/or the height of the projecting portion 6 according to the kind of iron golf club head. In addition, and as shown in FIG. 5, the constituent material of each of the blade portion 5 and the projecting portion 6 may differ from that of the club head body 1. If the blade portion 5 and the projecting portion 6 are composed of a material which is greater in specific gravity than the material of the club head body 1, the weight of the club head body 1 can be adjusted even if the dimensions of the blade portion 5 and those of the projecting portion 6 can be made constant or small. As the constituent material of each of the blade portion 5 and projecting portion 6, it is preferable to use a metal having a high specific gravity, such as tungsten or lead.

A cavity Q for weight adjustment, which is defined by the face portion 3, the blade portion 5, the sole portion 4 and the projecting portion 6, is provided on the back side of the face portion 3 of the club head body 1. The weight of the club head body 1 can also be adjusted by varying the volume of the cavity Q.

In accordance with the above-described preferred embodiment, extremely easy working can be achieved because, in order to distribute the weight of the club head body 1 during the manufacture thereof, the blade portion 5 having a predetermined length and the projecting portion 6 having a predetermined height are respectively formed integrally with the top portion 3*b* of the face portion 3 of the club head body 1 and the back-side end 4*a* of the sole portion 4 as weights which respectively continuously extend from the top portion 3*b* and the back-side end 4*a*. In addition, since there is no need for the conventional greatly time-consuming operation of attaching and adjusting separately formed weights to a club head body, the manufacturing costs of iron golf club heads can be reduced.

In addition, since the blade portion 5 and the projecting portion 6 are simultaneously provided at vertically separate positions of the club head body 1, the depth of the center of gravity is made great so that a ball can readily be lofted when it is hit. In addition, since the longitudinal moment of inertia of the club head body 1 is made large, a vertical deviation in the direction of flight of a hit ball is made small so that a ball can be hit with a stable carry.

Furthermore, since the blade portion 5 extends from the top portion 3*b* of the face portion 3 toward the back side X in the obliquely upward direction, the area of the face portion 3 appears large to the eyes of a player so that the player feels secure when hitting the ball.

As described above, in accordance with the present invention, a club head body is formed integrally with a blade portion for weight adjustment which extends from a top portion of a face portion toward a back side in an obliquely upward direction and a projecting portion for weight adjustment which projects from a back-side end of a sole portion in an upward direction. Accordingly, it is possible to provide an iron golf club head whose club head body has an increased longitudinal moment of inertia so that a vertical deviation in the direction of a hit ball is reduced and a stable stroke having an accurate carry can be attained, as well as which can readily be worked at low manufacturing costs.

Further, in accordance with the present invention, since the area of a face portion appears large to the eyes of a player owing to the blade portion which extends toward the back side in the obliquely upward direction, the player feels secure when hitting a ball.

What is claimed is:

1. An iron golf club head comprising a club head body including a hosel portion into which to fit a shaft, a face portion connected to said hosel portion, and a sole portion which is integrally formed to extend from a bottom edge portion of said face portion to a back side, wherein said club head body is formed integrally with a blade portion for weight adjustment which extends from a top portion of said face portion toward said back side in an obliquely upward direction and a projecting portion for weight adjustment which projects from a back-side end of said sole portion in an upward direction.

2. An iron golf club head according to claim 1, wherein a cavity for weight adjustment, which is defined by said face portion, said blade portion, said sole portion and said projecting portion, is provided on a back side of said face portion.

3. An iron golf club head according to claim 1, wherein an inclination angle of said blade portion with respect to the face portion is 40°–60°.

4. An iron golf club head according to claim 1, wherein said blade portion and said projecting portion are composed of a material which is greater in specific gravity than a material of said club head body.

5. An iron golf club head according to claim 4, wherein said blade portion and said projecting portion are composed of tungsten.

6. An iron golf club head according to claim 4, wherein said blade portion and said projecting portion are composed of lead.

* * * * *